US009585494B2

(12) United States Patent
Burns et al.

(10) Patent No.: US 9,585,494 B2
(45) Date of Patent: Mar. 7, 2017

(54) INFANT LOUNGER

(75) Inventors: Stephen Burns, Cumming, GA (US); Jacob Sclare, Dacula, GA (US); David Gilbert, Cumming, GA (US)

(73) Assignee: KIDS II, INC., Atlanta, GA (US)

( * ) Notice: Subject to any disclaimer, the term of this patent is extended or adjusted under 35 U.S.C. 154(b) by 0 days.

(21) Appl. No.: 13/571,514

(22) Filed: Aug. 10, 2012

(65) Prior Publication Data

US 2013/0038104 A1 Feb. 14, 2013

Related U.S. Application Data

(60) Provisional application No. 61/521,964, filed on Aug. 10, 2011.

(51) Int. Cl.
*A47D 13/10* (2006.01)
*A47D 13/02* (2006.01)

(52) U.S. Cl.
CPC ..... *A47D 13/02* (2013.01); *A47D 13/10* (2013.01); *A47D 13/102* (2013.01)

(58) Field of Classification Search
CPC ..... A47D 13/10; A47D 13/102; A47D 13/02
USPC ..... 297/131, 132, 133, 270.1, 270.2
See application file for complete search history.

(56) References Cited

U.S. PATENT DOCUMENTS 2,281,629 A 5/1942 Snow
2,788,056 A 4/1957 Parker
2,854,062 A * 9/1958 Hetchler ..... 297/270.3 X
3,047,333 A 7/1962 Stanimir
3,451,672 A * 6/1969 Kazdan ..... A63G 11/00 297/451.13 X
3,494,613 A 2/1970 Hatfield
3,526,429 A * 9/1970 Metzger ..... 297/271.5 X
3,633,222 A 1/1972 Greenfield
3,653,080 A 4/1972 Hafele
4,371,206 A * 2/1983 Johnson, Jr. ..... 297/270.2 X
4,500,133 A * 2/1985 Nakao et al. ..... 297/131
4,516,282 A 5/1985 Topalian et al.
4,566,449 A 1/1986 Smith
4,620,334 A 11/1986 Robinson
4,631,766 A 12/1986 Semmler et al.
4,634,175 A 1/1987 Wise
4,667,356 A 5/1987 Holmquist
4,738,488 A 4/1988 Camelio
4,802,244 A 2/1989 McGrath-Saleh
4,862,535 A 9/1989 Roberts
4,891,852 A 1/1990 Lopez, Jr.
5,244,292 A 9/1993 Wise
5,265,932 A * 11/1993 Leonard ..... 297/131
5,308,143 A 5/1994 Cheng et al.
5,383,711 A 1/1995 Houghteling
5,437,061 A * 8/1995 Kenner ..... 297/184.13 X
(Continued)

FOREIGN PATENT DOCUMENTS

WO 2014153490 A1 9/2014

*Primary Examiner* — Anthony D Barfield
(74) *Attorney, Agent, or Firm* — Gardner Groff Greenwald & Villanueva, PC

(57) ABSTRACT

A lounger seat, as for infants or children, having a body with a seating area, sidewalls for retaining the child in the seating area, and a non-flat lower surface for supporting the lounger on a support surface. In example embodiments, the non-flat lower surface allows rocking of the lounger. A kickstand or brace is optionally extendable to block the lounger from rocking, or retractable to permit rocking.

23 Claims, 10 Drawing Sheets

(56) References Cited

U.S. PATENT DOCUMENTS

| | | | | |
|---|---|---|---|---|
| 5,439,008 | A | 8/1995 | Bowman | |
| 5,440,770 | A | 8/1995 | Nichols | |
| 5,499,949 | A | 3/1996 | Heubl | |
| D372,805 | S | 8/1996 | Bonaddio et al. | |
| 5,551,109 | A | 9/1996 | Tingley et al. | |
| 5,800,368 | A | 9/1998 | Klingemann et al. | |
| 5,803,535 | A * | 9/1998 | Jane Cabagnero | 297/271.6 X |
| 5,935,010 | A | 8/1999 | Clarke | |
| 6,023,802 | A | 2/2000 | King | |
| 6,036,263 | A | 3/2000 | Gold | |
| 6,052,849 | A | 4/2000 | Dixon et al. | |
| 6,052,850 | A | 4/2000 | Salido et al. | |
| 6,116,691 | A * | 9/2000 | Reece | 297/397 X |
| 6,174,028 | B1 | 1/2001 | Yang et al. | |
| 6,253,400 | B1 | 7/2001 | Rudt-Sturzenegger et al. | |
| 6,266,832 | B1 | 7/2001 | Ezell | |
| 6,292,964 | B1 | 9/2001 | Rose et al. | |
| 6,321,403 | B1 | 11/2001 | Matthews | |
| 6,361,106 | B1 | 3/2002 | Huang | |
| 6,363,558 | B1 | 4/2002 | Dunne | |
| 6,473,923 | B1 | 11/2002 | Straub | |
| 6,536,058 | B1 | 3/2003 | Chang | |
| 6,539,567 | B1 | 4/2003 | Bae | |
| 6,540,292 | B2 | 4/2003 | Darling et al. | |
| 6,679,779 | B2 | 1/2004 | Tai et al. | |
| 6,682,137 | B2 | 1/2004 | Hsia | |
| 6,811,217 | B2 * | 11/2004 | Kane et al. | 297/270.2 |
| 6,823,545 | B1 | 11/2004 | Davis | |
| D500,622 | S | 1/2005 | Owen | |
| 6,848,128 | B2 | 2/2005 | Verbovszky et al. | |
| 6,877,176 | B2 | 4/2005 | Houghteling | |
| 6,922,861 | B1 | 8/2005 | Mathis | |
| 6,966,089 | B2 | 11/2005 | Gold et al. | |
| 6,968,586 | B2 | 11/2005 | Havenor et al. | |
| 7,059,000 | B2 | 6/2006 | Verbovszky | |
| D530,933 | S | 10/2006 | Vitaro | |
| 7,117,553 | B2 | 10/2006 | Fairchild et al. | |
| 7,234,181 | B1 | 6/2007 | Griggs | |
| 7,252,330 | B2 | 8/2007 | Lincoln | |
| 7,418,752 | B2 | 9/2008 | Kemm | |
| 7,430,765 | B2 | 10/2008 | Brown et al. | |
| 7,445,281 | B2 | 11/2008 | Kassai | |
| 7,506,922 | B2 * | 3/2009 | Schulte et al. | 297/131 X |
| 7,581,268 | B2 | 9/2009 | Bell | |
| 7,588,291 | B2 | 9/2009 | Gold et al. | |
| D608,102 | S | 1/2010 | Kemm | |
| 7,647,660 | B2 | 1/2010 | Tullous | |
| D610,853 | S | 3/2010 | Straub | |
| 7,698,763 | B2 | 4/2010 | Warnock | |
| 7,698,764 | B2 | 4/2010 | Kemm | |
| 7,716,764 | B2 | 5/2010 | Joe et al. | |
| 7,810,501 | B2 | 10/2010 | Rogers et al. | |
| 7,862,118 | B2 * | 1/2011 | Sims, Jr. | 297/260.2 |
| 7,886,382 | B2 | 2/2011 | Funatogawa | |
| 8,038,207 | B2 | 10/2011 | Flannery | |
| 8,069,856 | B2 | 12/2011 | Kell | |
| 8,074,312 | B2 | 12/2011 | Tullous | |
| 8,096,304 | B2 | 1/2012 | Scott et al. | |
| 8,205,943 | B2 | 6/2012 | Zhong | |
| 8,332,978 | B2 | 12/2012 | Warnock | |
| 8,746,794 | B2 | 6/2014 | Oren et al. | |
| 8,844,072 | B2 | 9/2014 | Bellows et al. | |
| 8,870,285 | B2 | 10/2014 | Williams et al. | |
| 2005/0264063 | A1 * | 12/2005 | Babcock et al. | 297/250.1 |
| 2006/0042013 | A1 | 3/2006 | Madsen | |
| 2006/0103178 | A1 | 5/2006 | Wun | |
| 2007/0007804 | A1 | 1/2007 | Pemberton et al. | |
| 2007/0287942 | A1 | 12/2007 | Tullous | |
| 2008/0029103 | A1 | 2/2008 | Regev et al. | |
| 2008/0060134 | A1 | 3/2008 | Virga | |
| 2008/0184489 | A1 | 8/2008 | Pham | |
| 2009/0007336 | A1 | 1/2009 | Kassai et al. | |
| 2009/0249526 | A1 | 10/2009 | Carangelo | |
| 2010/0058538 | A1 | 3/2010 | Rieber | |
| 2010/0180381 | A1 | 7/2010 | Verde Sanchez et al. | |
| 2011/0148155 | A1 | 6/2011 | Chapman et al. | |
| 2011/0227384 | A1 | 9/2011 | Huntsberger et al. | |

* cited by examiner

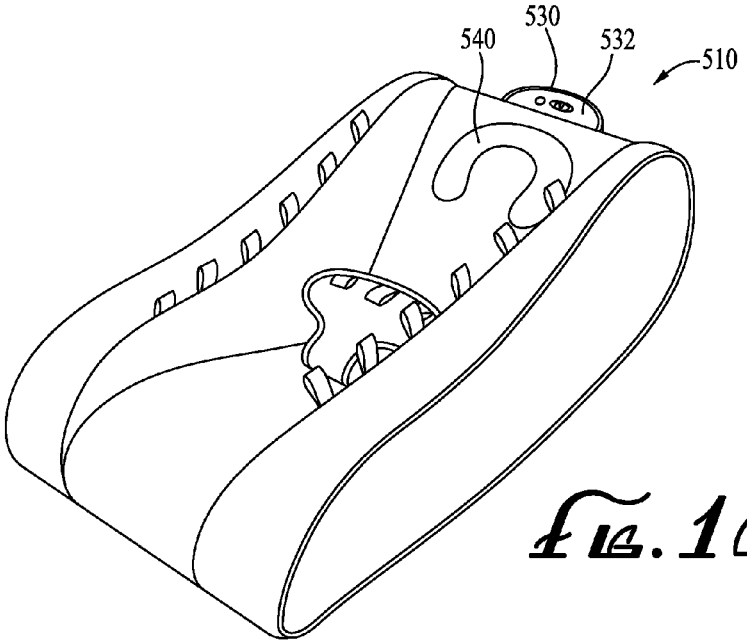
FIG. 16
FIG. 17
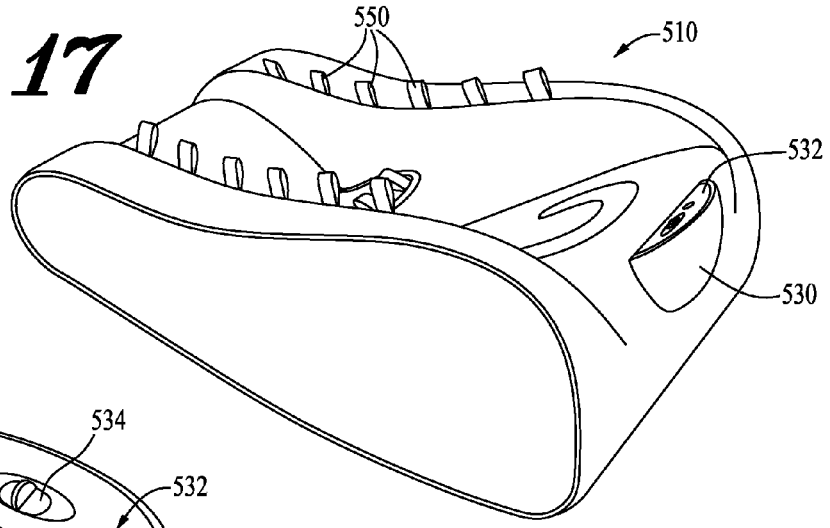
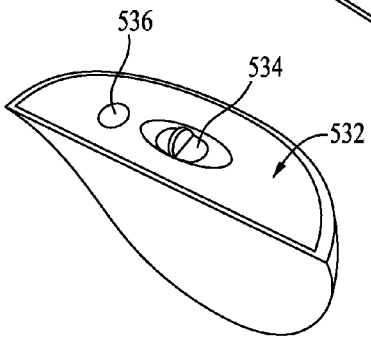
FIG. 18

INFANT LOUNGER

CROSS-REFERENCE TO RELATED APPLICATIONS

This application claims the benefit of U.S. Provisional Patent Application Ser. No. 61/521,964 filed Aug. 10, 2011, the entirety of which is hereby incorporated by reference herein.

TECHNICAL FIELD

The present invention relates generally to furniture and bedding, and more particularly to a lounger as for use by infants or children.

SUMMARY

In example embodiments, the present invention provides a lounger for reclined seating of an infant or child, configured with an upper support surface and a curved lower surface that allows the lounger to rock. Various sensory accessories are optionally included for tactile, visual or audible interaction of the child.

In one aspect, the present invention relates to a lounger for supporting a user in a reclined position. The lounger preferably includes a central support portion having a first support surface for supporting the user's head and back, a second support surface for supporting the user's legs, and a seat area between the upper and lower portions. The lounger preferably also includes first and second side portions extending above the central support portion along opposite sides thereof. The lounger preferably also includes a non-flat base for supporting the lounger on a support surface, the non-flat base defining at least one contact point with the support surface and at least one point not in contact with the support surface.

In another aspect, the invention relates to a lounger including a foam core having a central support portion defining a head end, a foot end, a first side and a second side. The foam core further includes a first sidewall portion extending above at least a portion of the central support portion along the first side, and a second sidewall portion extending above at least a portion of the central support portion along the second side. The lounger preferably also includes an arcuate lower surface allowing a rocking motion of the lounger.

In still another aspect, the invention relates to a lounger including a body having an upper surface defining a seating area, and a lower surface at least a portion of which is curved to permit rocking. The lounger preferably also includes a kickstand for selective operation to allow or prevent rocking of the body.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of the invention are exemplary and explanatory of preferred embodiments of the invention, and are not restrictive of the invention, as claimed.

BRIEF DESCRIPTION OF THE DRAWINGS

FIG. 16 is a first perspective view of a lounger according to another example embodiment of the present invention.

FIG. 17 is a second perspective view of the lounger of FIG. 16.

FIG. 18 is a detailed view of a sound transmitter component of the lounger of FIG. 16 in example form.

DETAILED DESCRIPTION OF EXAMPLE EMBODIMENTS

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Figure 1:
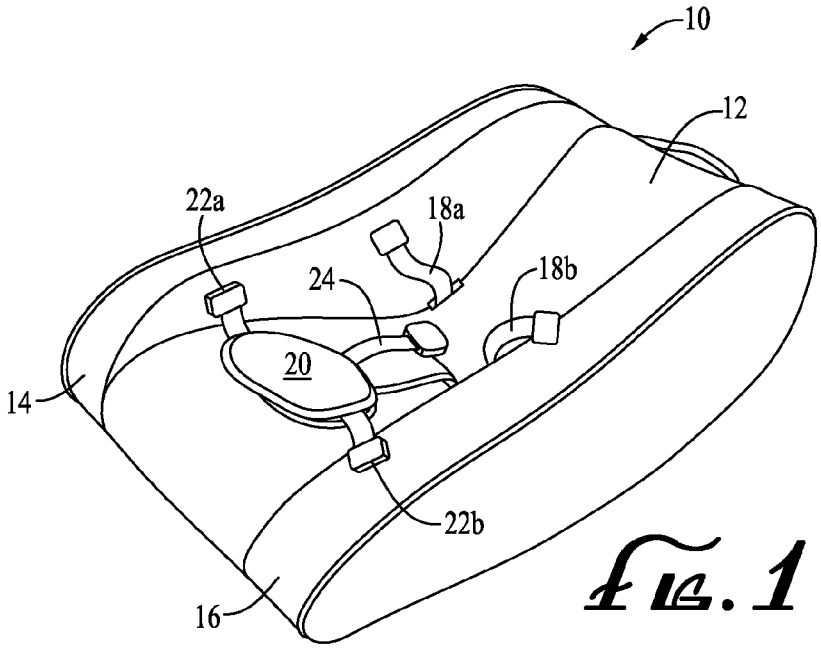
FIG. 1 is a first perspective view of a lounger according to an example embodiment of the present invention.
Figure 2:
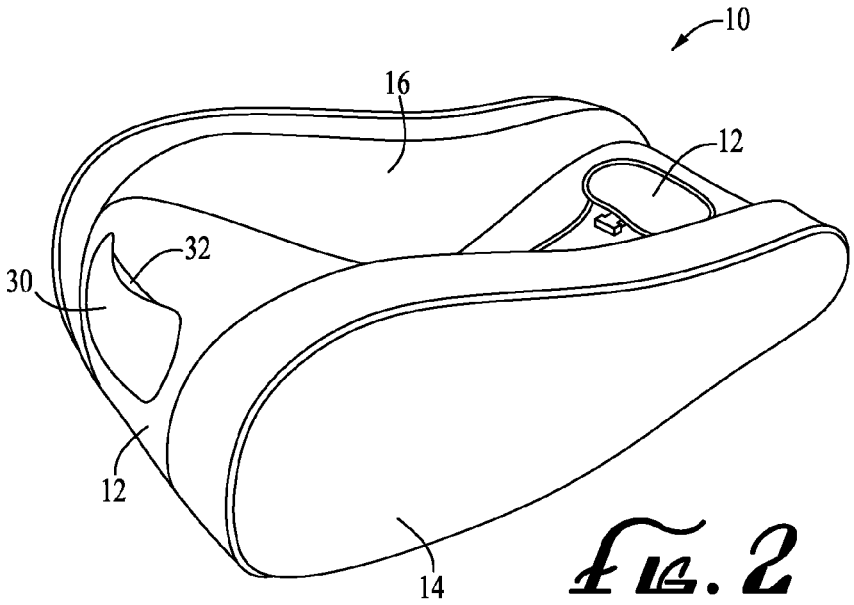
FIG. 2 is a second perspective view of the lounger of FIG. 1.
Figure 3:
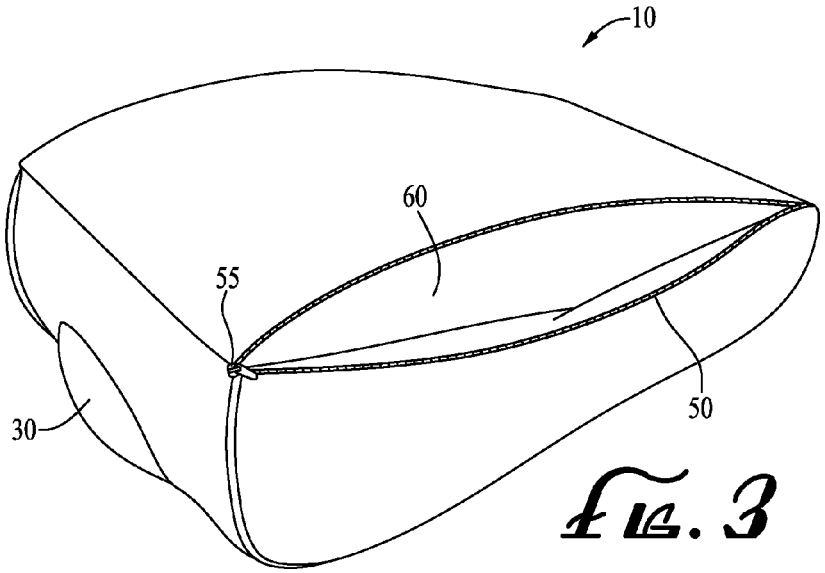
FIG. 3 is a perspective view from below of the lounger of FIG. 1, with a slipcover portion partially opened to show internal structure.

With reference to an example embodiment shown in FIGS. 1-3, a lounger 10 generally comprises a central support portion 12 bounded by first and second sidewalls 14, 16 along opposite lateral sides of the central support portion 12. The central support portion 12 is generally concave and defines a length and a width sufficient to comfortably support a child or infant thereon. The central support portion 12 comprises an upper portion for supporting the child's head and back, a lower portion for supporting the child's legs, and a seat portion between the upper and lower portions for supporting the child's seat. The upper and lower portions of the central support portion 12 are preferably oriented at an obtuse angle relative to one another, for example about 100°-170°, and more preferably about 120°-160°. The seat portion preferably comprises a smoothly radiused transition between the upper and lower portions, or alternatively can comprise an angled transition. In an example embodiment, the width of the central support portion 12 is greater at the ends of the upper and lower portions, and narrower in the seat portion, defining an hourglass-shaped profile. For example, the central support portion 12 may have a width of about 6"-8" at the seat portion, progressively widening to about 9"-12" at the ends of the upper and lower portions. In an example embodiment, the lounger has an end-to-end length of about 24"-36", for example about 30"; and an overall side-to-side width of about 16"-18", for example about 17". In its normal equilibrium or resting state, the upper portion or head end of the central support portion 12 is elevated above the lower portion or foot end. For example, the head end may be positioned at an elevation of about 10"-12" above the support surface upon which the lounger is placed, and the foot end at an elevation of about 6"-8".

The sidewall portions 14, 16 extend generally upright or at a slight outward inclination from the central support portion 12, along substantially all or at least a central portion of the length thereof, to prevent a child seated or reclining in the lounger from accidentally rolling off the central support portion. The central support portion is generally concave, with the seat portion recessed inwardly, resulting in a greater height of the sidewall portions 14, 16 in the area of the seat portion, and a lesser height of the sidewall portions toward the ends of the upper and lower portions. In an example embodiment, the height of the sidewall portions is about 6"-8" above the seat portion, tapering to about 1"-2" toward the ends. The outer side faces of the sidewall portions 14, 16 are generally parallel to one another, and when the lounger 10 is supported on a floor, table or other support surface for normal use the outer side faces of the sidewall portions are positioned generally vertically, perpendicular to the support surface; and the side-to-side span of the central support portion 12 is positioned generally horizontally, parallel to the support surface.

The lounger 10 optionally further comprises a harness or strap system to secure a child in a seated or reclining position within the lounger. As depicted, a pair of waist belt straps 18*a*, 18*b* are releasably engagable with a central coupling panel 20 having cooperating coupling elements or belts 22*a*, 22*b*, and a crotch strap 24 extending therefrom, to form a three-point harness system. Alternatively, a single, two-sided buckle can be attached to the crotch strap for engagement with corresponding coupling elements on the waist belt straps 18*a*, 18*b*. Buckles, snaps, clips, hook-and-loop fasteners or other releasable coupling means can be provided for attaching the straps to secure the child. In alternate embodiments, differing strap configurations may be utilized, for example a simple two-point waist belt, a five-point harness including shoulder straps, or various other configurations.

The lounger 10 optionally also includes a pocket 30, for example, proximal the head end of the upper portion of the central support portion 12, for containing a sound transmitter 32, vibration transducer, portable music player or other accessory. In the example embodiment of FIGS. 1-3, the lounger 10 comprises a removable fabric slipcover 50 having a zipper 55 or other closure or attachment means, covering a compressible foam core or inner body 60. The foam core 60 can, for example, comprise an integral unitary molding of polyurethane foam; or can comprise separate sections of differing materials, for example a softer more compressible central support portion and firmer or denser sidewall portions The lower surface of the lounger 10, seen with reference to FIG. 3, defines an outwardly curved surface, allowing the lounger 10 to rock. In the depicted embodiment, the lower surface of the lounger 10 is curved from end to end in the lengthwise or longitudinal direction of the lounger, allowing for forward and backward rocking; and is flat in the transverse or side to side direction. Alternatively, the lower surface of the lounger 10 can be curved along the transverse direction for side to side rocking, or can be convex for both lengthwise and transverse rocking. Optionally, a generally flat section is provided at one or both ends of the curved lower surface to define the forward and backward limits of the rocking motion of the lounger 10. In example embodiments, the ends of the rocking surface are elevated about 1"-3" above the medial portion of the rocking surface that contacts the underlying support surface in the equilibrium state of the lounger, for example about 2", such that each end is displaced upwardly and downwardly from its equilibrium position over a vertical span of up to about 2"-6", for example up to about 4", upon rocking. In alternate embodiments, the lower surface of the lounger can comprise various different non-flat or non-planar profiles that may or may not enable rocking, for example, an undulating surface with two or more contact points for supporting the lounger on a floor, table or other support surface, and at least a portion of the undulating surface not contacting the support surface. For example in a non-rocking embodiment, at least two contact points of the lower surface of the lounger contact an underlying flat support surface, and at least one non-contact portion of the lower surface of the lounger positioned between the contact points is above and not in contact with the support surface. In a rocking embodiment, at least one contact point of the rocker surface contacts the support surface as the lounger rocks, while other points of the rocker surface are elevated above and not in contact with the support surface.

Figure 4:
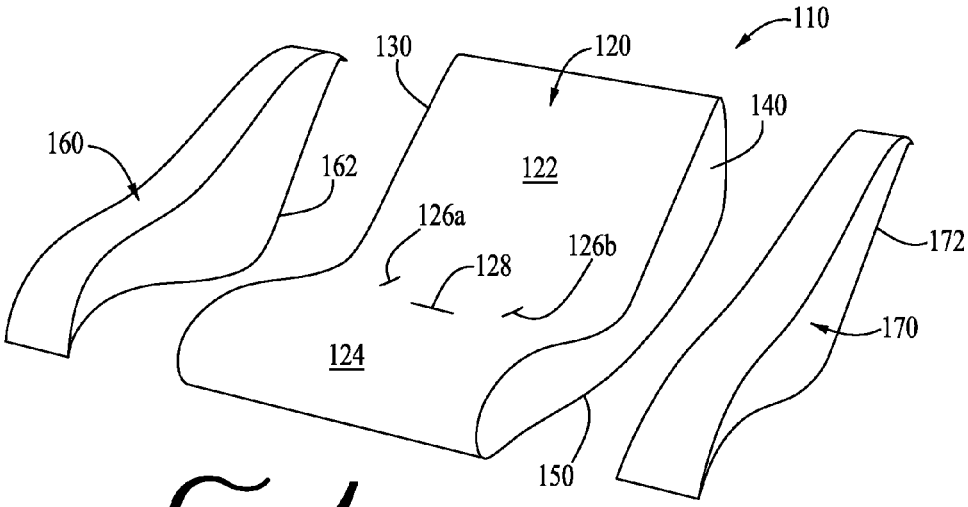
FIG. 4 is a first assembly view of components of a lounger according to an example embodiment of the present invention.
Figure 5:
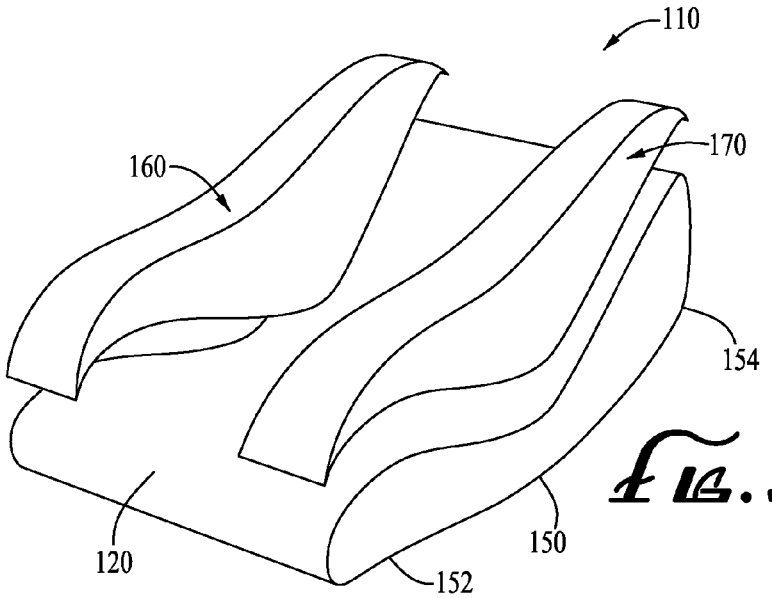
FIG. 5 is a second assembly view of the lounger components of FIG. 4.
Figure 6:
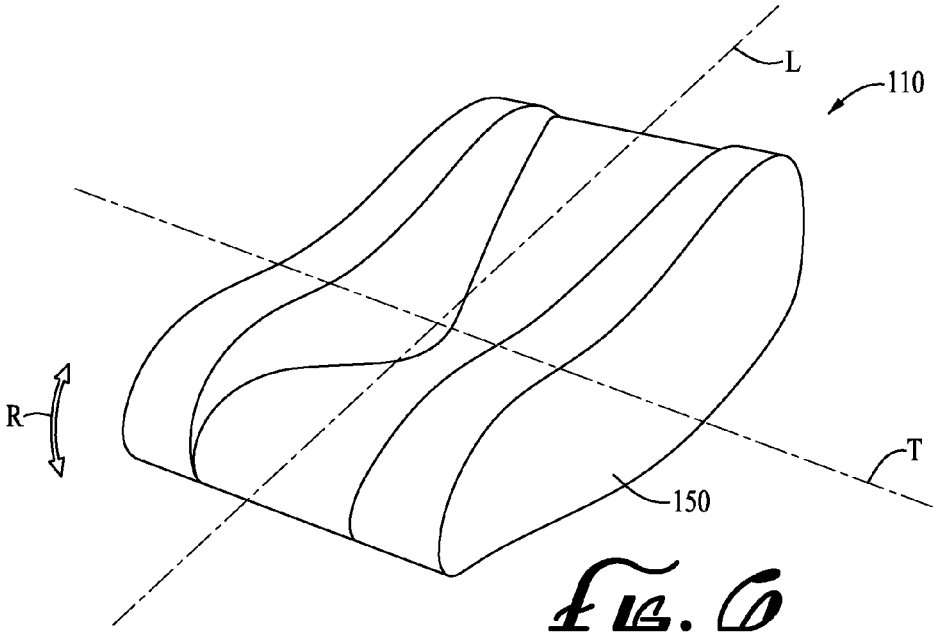
FIG. 6 is an assembled view of the lounger components of FIG. 4.
Figure 7:
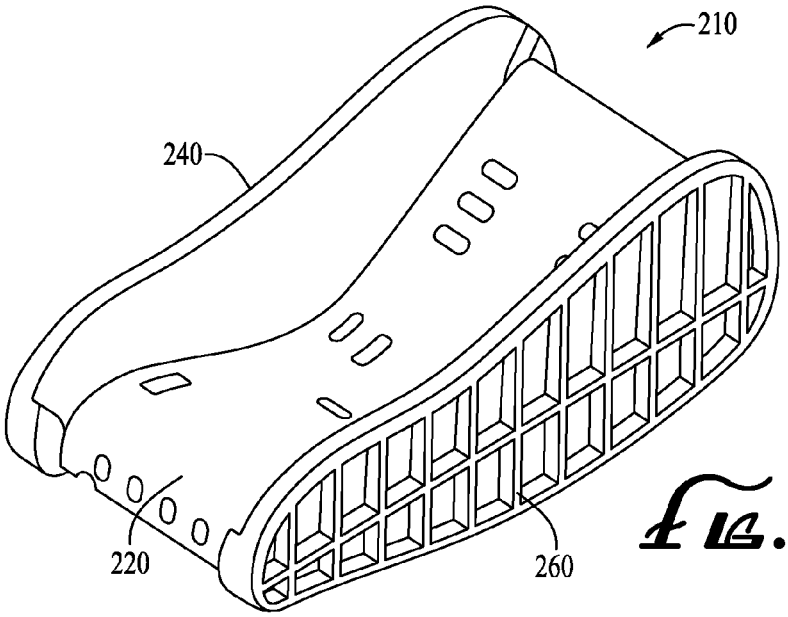
FIG. 7 is a first perspective view of an inner base structure of a lounger according to another example embodiment of the present invention.
Figure 8:
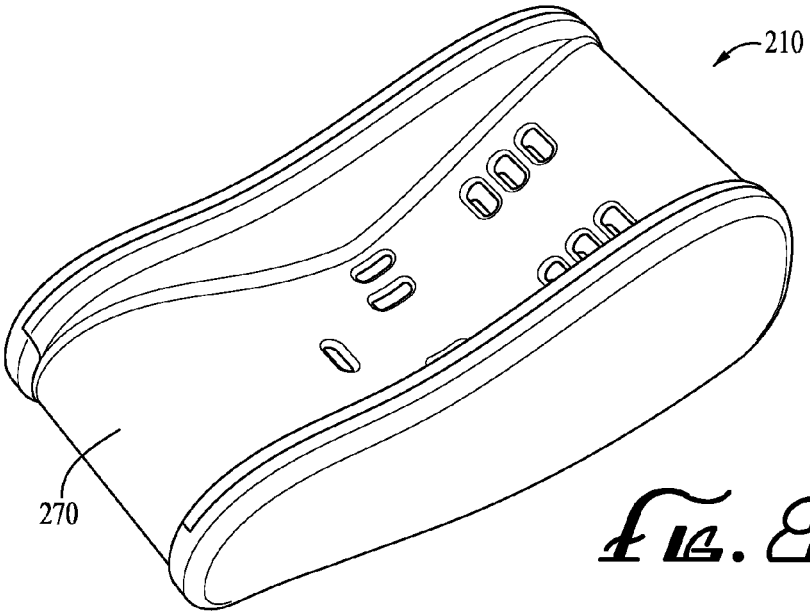
FIG. 8 is a perspective view of a lounger incorporating the inner base structure of FIG. 7.
Figure 9:
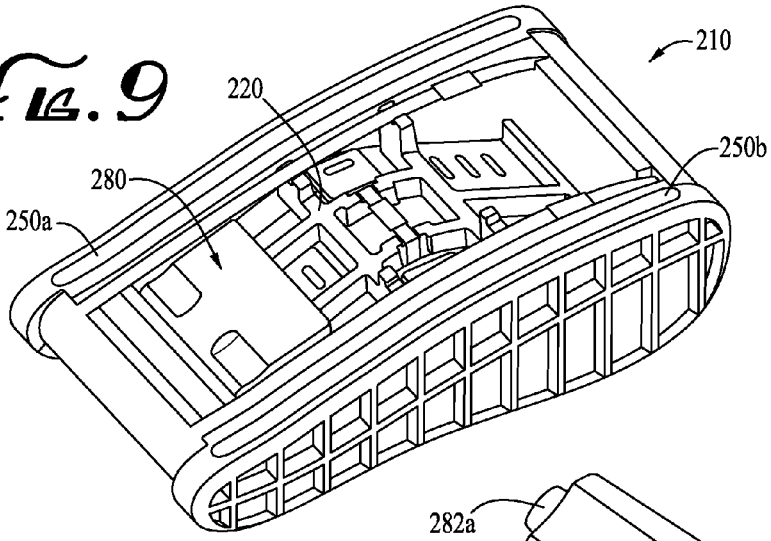
FIG. 9 is a perspective view from below showing a brace or kickstand assembly of the base structure of FIG. 7, in a retracted configuration.
Figure 10:
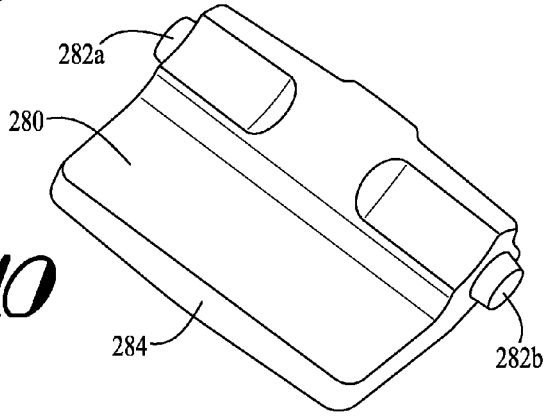
FIG. 10 is a detailed view of the brace or kickstand of the base structure shown in FIG. 9.
Figure 11:
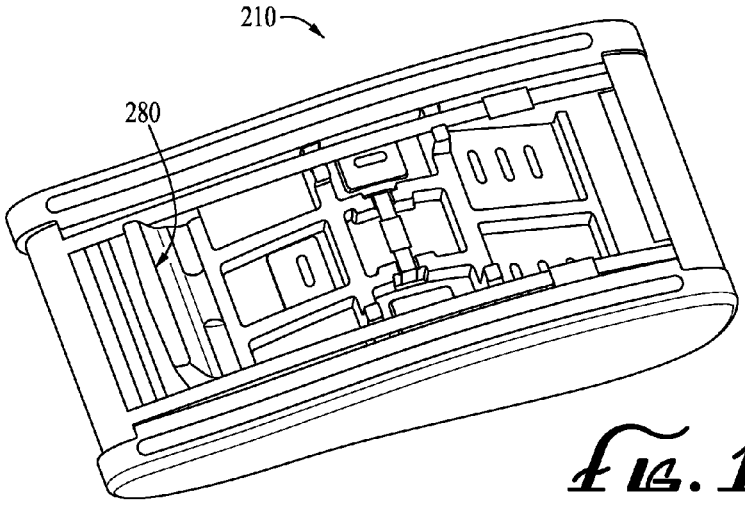
FIG. 11 shows the brace or kickstand assembly in an extended configuration.
Figure 12:
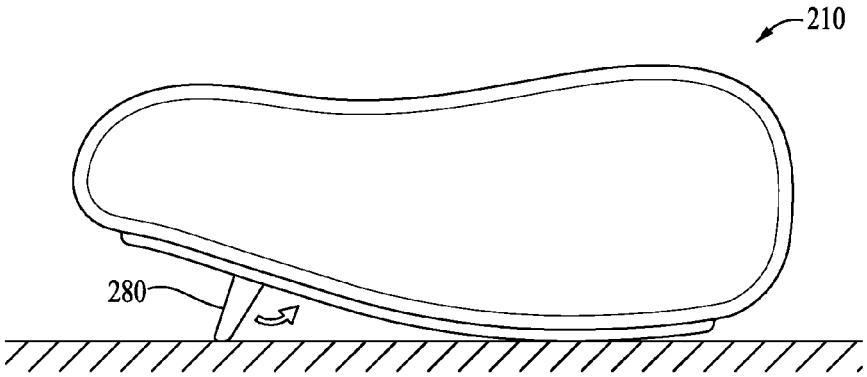
FIG. 12 is a side view of the lounger of FIG. 8 showing the brace or kickstand assembly in its extended configuration.

FIGS. 4-6 show a sequence of fabrication of a foam core of a lounger 110 according to another example embodiment. The foam core generally comprises a central support portion 120 and first and second sidewall portions 160, 170. The central support portion 120 comprises an upper portion 122 and a lower portion 124, and first and second sides 130, 140. A pair of waist-belt slots 126*a*, 126*b* and a crotch strap slot 128 are formed through the foam core adjacent the seat portion between the upper and lower portions 122, 124. The upper surface of the central support portion 120 defines a smoothly curved, inwardly recessed profile, and the sidewall portions 160, 170 have complementary outwardly curved profiles along their lower surfaces 162, 172, as seen best in FIG. 5. In this manner, the sidewall portions 160, 170 are assembled into engagement with the upper surface of the central support portion 120, in alignment with sides 130, 140, and attached by adhesive, solvent or thermal bonding, or other attachment means. Optionally, a reinforcement layer such as a non-woven polypropylene reinforcement panel is laminated or otherwise attached in the area of the slots 126, 128 to resist the straps pulling through or detaching from the foam core. Optionally, one or more stiffeners or braces are incorporated in or on the foam core for structural support.

The lower surface of the foam core of the lounger 110 defines an outwardly curved, non-planar central portion 150 between a lower or foot end portion 152 and an upper or head end portion 154. The arcuate curvature of the central portion 150 allows the lounger to rock or pivot about a transverse or side-to-side axis T, in a lengthwise direction L, as indicated by the arcuate rocking motion R. One or more base frame members are optionally provided at the forward and/or rear ends of the rocking surface to limit the magnitude of rocking motion of the lounger. The foam core of the lounger 110 is optionally covered by a fabric cover, or provided with a coating, laminate or other surface treatment for comfort, stain resistance, and/or application of decorative graphics, user information or branding indicia.

FIGS. 7-12 show another example embodiment of a lounger 210. The rocker 210 generally comprises a substantially rigid body including a central support portion 220 and first and second sidewalls 240, 260 along both sides of the central support portion. The substantially rigid body of the lounger is formed, for example, as a unitary molding of expanded polypropylene. In alternate embodiments, the body can be fabricated of plastics, metals, wood, composites or other materials, and can comprise a unitary integral piece, or can comprise multiple separate pieces joined together by fasteners, adhesive, thermal welding, solvent bonding or other attachments. The first and second sidewalls 240, 260 optionally comprise one or more raised arcuate rocker rails 250*a*-*b* on their lower side, for example formed of a low-friction material to minimize scuffing or marring the support surface upon which the lounger 210 rocks, or formed of the same material and integrally molded into the main body.

One or more strap or harness slots or mounting attachments are optionally formed in or provided on the central support portion 220 and/or the first and second sidewalls 240, 260 for securing a strap or harness. A foam pad or cover 270 is applied on or over the central support portion 220, and optionally on or over at least a portion of the first and second sidewalls 240, 260 for improved user comfort. One or more straps, clips or fasteners may be provided to secure the pad or cover 270 to the plastic body of the lounger 210.

With reference to FIGS. 9-12, the depicted embodiment further comprises a brace or kickstand 280 pivotally mounted to the underside of the lounger 210. The kickstand 280 is pivotal between a first or retracted position (shown in FIG. 9) which does not interfere with rocking motion of the lounger 210, and a second or extended position (shown in FIGS. 11 and 12) which props the lounger in a desired position and prevents rocking motion of the lounger. As seen in the detailed view of FIG. 10, the kickstand 280 comprises a mounting end having first and second circular mounting hubs 282*a*, 282*b* for engagement within cooperating recesses in the underside of the central support portion 220, and a second free end defining a foot 284 for engaging the floor, table or other support surface upon which the lounger 210 is placed. In this manner, a user can selectively pivot the kickstand 280 into the extended position to prevent rocking of the lounger 210 or into the retracted position to allow rocking. One or more kickstands may be positioned at different locations, for example proximal the head end of the lounger and/or proximal the foot end, whereby selective actuation of one or the other (or both) allows repositioning of the lounger at different reclining or sitting angles. In alternate embodiments, the kickstand(s) may take the form of a wedge that is stored in a recess in the lounger body, and retracted or flipped down and positioned under the rocker to prevent rocking; one or more spring-loaded feet that selectively pop down to engage the support surface at the corner(s) of the lounger; or other features or components to limit or prevent rocking of the lounger.

Figure 13:
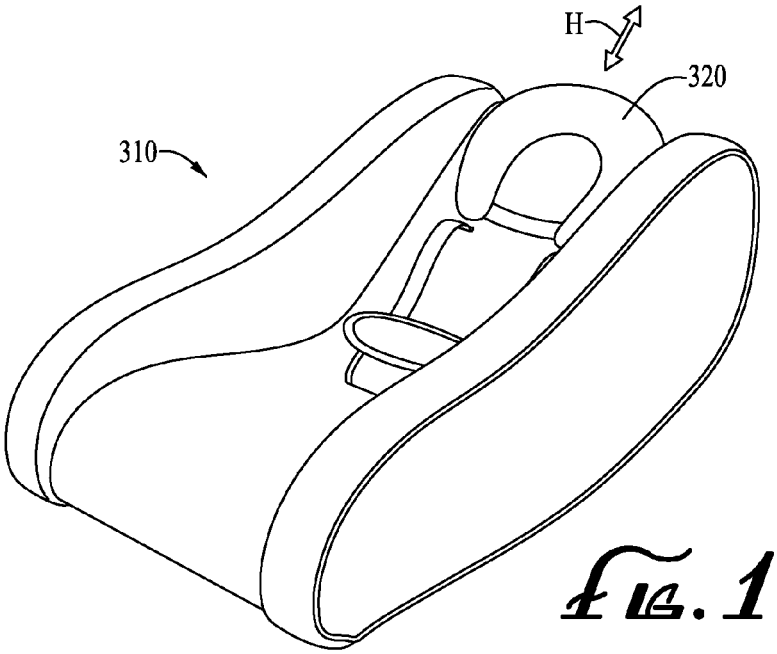
FIG. 13 is a perspective view of a lounger according to another example embodiment of the present invention.

FIG. 13 depicts another example embodiment of a lounger 310 according to the present invention. In this embodiment, a head support 320 is mounted for lengthwise translation (in the direction of directional arrow H), back and forth along the central support portion of the lounger 310. A user can selectively position the head support 320 within a range of positions to accommodate infants of different sizes. Optionally the head support 320 comprises a resilient foam core defining a peripheral ring with a central recess to prevent positional plagiocephaly (flattened head) that might result from prolonged localized spot pressure.

Figure 14:
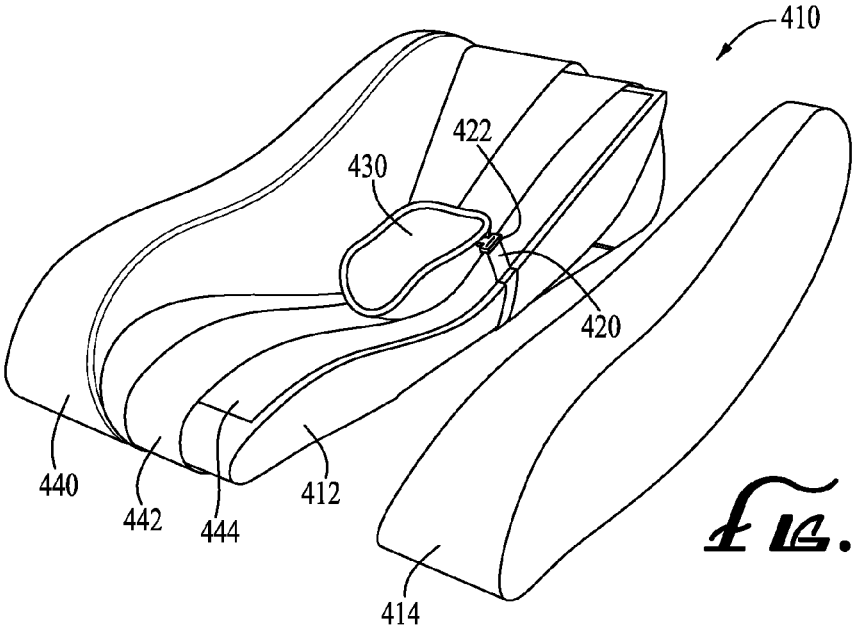
FIG. 14 is a perspective view in partial cutaway of a lounger according to another example embodiment of the present invention.
Figure 15:
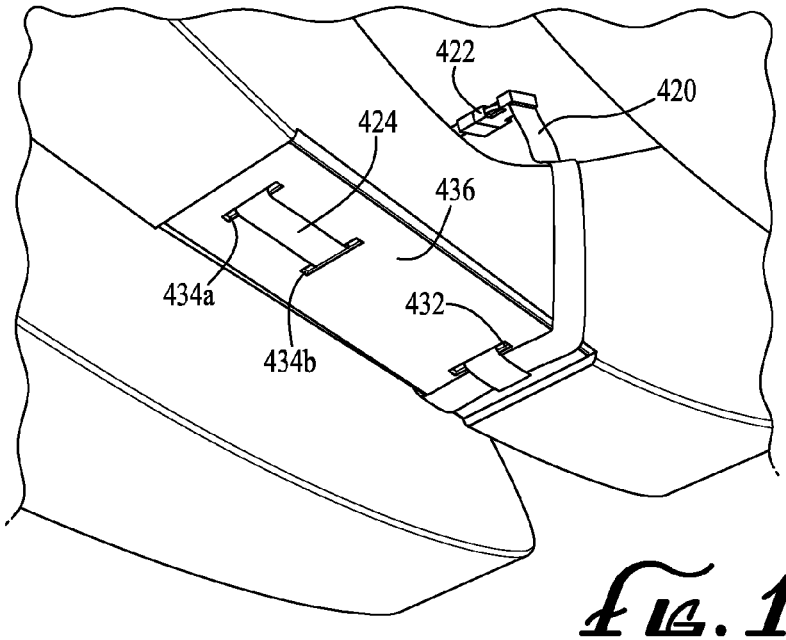
FIG. 15 is an assembly view of the lounger of FIG. 14, showing the installation of harness strap components in example form.

FIGS. 14 and 15 show further details of the construction of a lounger 410 according to another example embodiment of the invention. A foam core comprising a central support portion 412 and sidewalls 414 includes one or more slots or openings for receiving waist straps 420 of a three-point harness assembly. The foam core is preferably formed of a resilient polymeric material such as for example expanded polypropylene (EPP) foam, but may alternatively be formed from other synthetic or natural materials. A buckle or snap connector 422 releasably secures the waist straps 420 to a central harness panel 430, which positions the waist straps in relation to a crotch strap 424. A harness reinforcement panel 436 is optionally provided to resist pull-through of the straps 420, 424, and includes slots 432, 434 for alignment with corresponding slots in the foam core for receiving the straps. The foam core of the lounger 410 is covered with a fabric slipcover 440, and optionally one or more intermediate layers 442, 444 between the foam core and the slipcover for moisture or stain-resistance, breathability and/or comfort.

FIGS. 16-18 show additional features of a further embodiment of a lounger 510 according to the present invention. A fabric pocket 530 provided on the slipcover is configured to securely receive an electronic sound transmitter 532. The sound transmitter 532 optionally comprises a switch or controller 534 for powering the transmitter on and off, and controlling volume, and a second controller 536 for selecting one of a plurality of sound options. In further embodiments, the electronic sound transmitter may comprise a portable music player, radio, recorder, or the like. Alternatively or additionally, a vibration transducer may be provided. A raised head support ring 540 is optionally formed into or onto the slipcover for comfort and pressure distribution. One or more tactile and/or visual stimulation features, such as fabric loops 550 are optionally provided on the slipcover.

Figure 19:
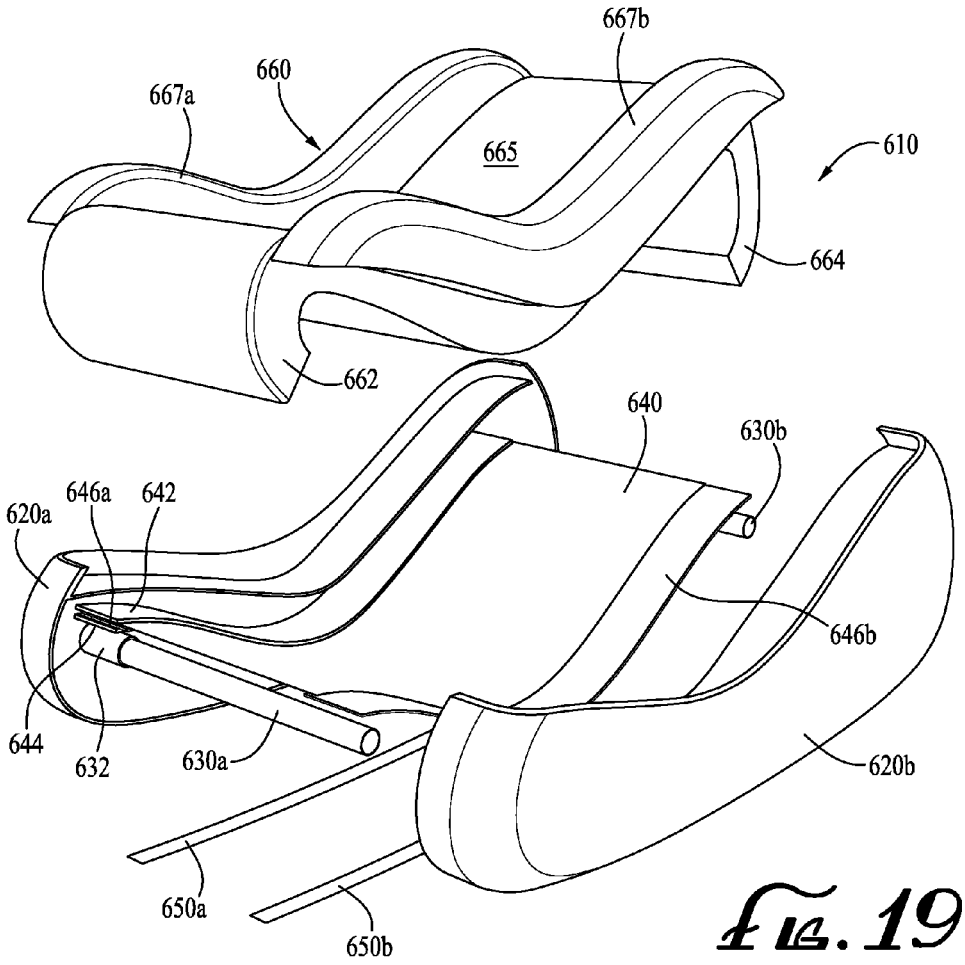
FIG. 19 is a perspective assembly view of a lounger according to another example embodiment of the present invention.

FIG. 19 shows another example embodiment of a lounger 610 according to the present invention. In this embodiment, the lounger 610 is collapsible or configured to knock down into separate components, for example for shipping and storage in a reduced volume container. First and second sidewall supports 620*a*, 620*b* receive front and rear cross-braces 630*a*, 630*b* in receiver collars 632 to form a rectangular support frame. A flexible support panel 640 is installed across the cross-braces 630*a*, 630*b* between the sidewall supports 620*a*, 620*b* to form a recessed seating surface. The flexible support panel 640 is retained in tension by engagement with the sidewall supports 620*a*, 620*b*, for example between retention flanges 642, 644 and a compression strip 646. A resilient support 660 is installed onto the support frame, with a first engagement portion 662 defining a curved portion for securing over the front cross brace 630*a*, and a second engagement portion 664 defining a curved portion for securing over the rear cross brace 630*b*. A curved mattress or seatback panel 665, for example formed of a foam, rubber, poly-fill batting, or other flexible and/or resilient material, overlies the flexible support panel 640 to provide a support surface for an infant seated or reclining thereon. Connector straps 650*a*, 650*b* are optionally provided to secure the seatback panel 665 in place on the support frame. Sidewall or armrest portions 667*a*, 667*b* extend upward from the seatback panel 665 and engage coupling elements of the sidewall supports 620*a*, 620*b* to form an integrated assembly. In this manner, the components of the lounger 610 can be shipped and stored in a knocked down or disassembled state for increased efficiencies, and easily and quickly assembled at the point of sale or use without the need for specialized skills or tooling.

Figure 20:
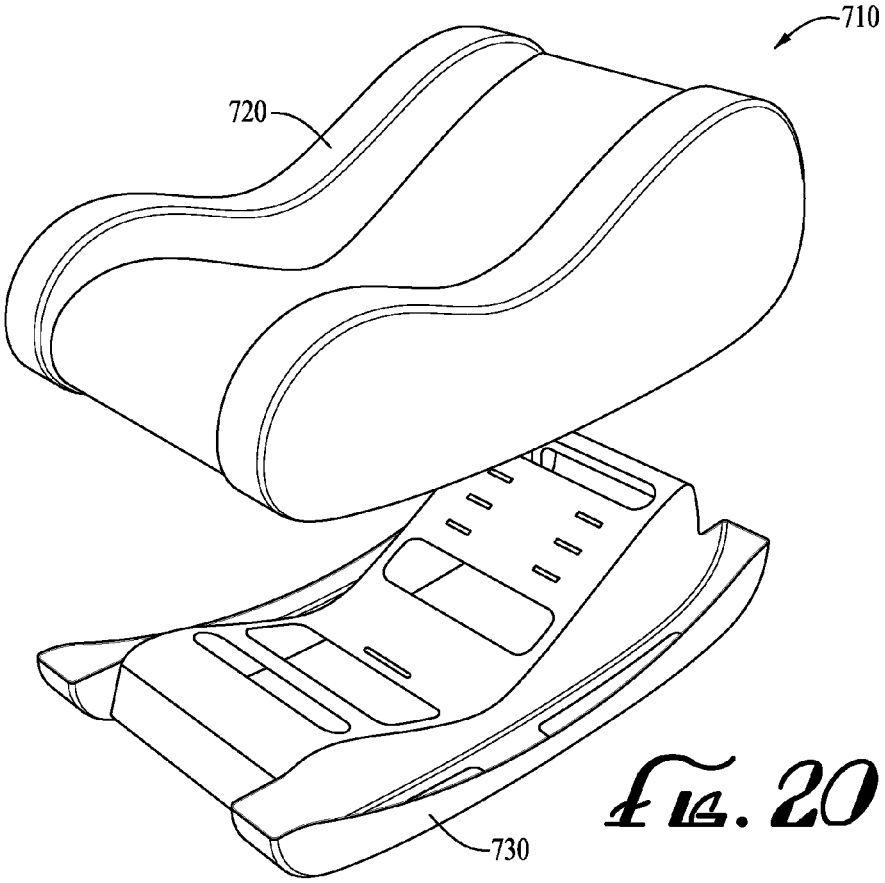
FIG. 20 is an assembly view of a lounger according to another embodiment of the invention.
Figure 21:
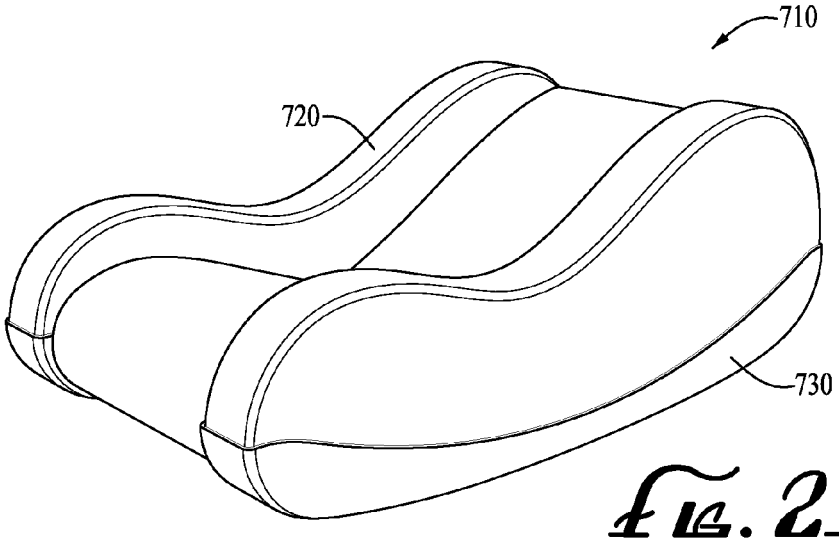
FIG. 21 is a perspective view of the assembled lounger of FIG. 20.

FIGS. 20 and 21 show another embodiment of a lounger 710 according to an example form of the invention. An expanded foam based upper seating body 720 has one or more surface features for engagement within cooperating receiver portion(s) of a hard plastic base 730. The seating body 720 is received with a snug fit within the base 730 to retain the lounger in its assembled state. One or more fasteners, adhesive, or other attachment means are optionally provided between the base 730 and the seating body 720 for more secure attachment.

Various additions and modifications to the example embodiments of an infant lounger depicted and discussed herein are contemplated as being within the scope of the present invention. Notably, it is contemplated that the description herein of the orientation, location, dimensions, shape, material, and construction method of various features is in no way limiting and may be modified while remaining within the scope. For example, the lounger may be configured to rock in any direction, such as front-to-back and/or side-to-side, or alternatively may not be configured for any rocking movement. The lounger may or may not include a recline mechanism that allows the torso support portion (and/or the leg support portion to be selectively adjusted between various angles relative to the support surface, such as, for example, between 0°, 10°, 20°, and 30°. The lounger may also include a toy bar or toy rings for the attachment of toy accessories. Furthermore, the rocking motion of the lounger may be driven in a variety of ways, such as, for example, manually by a caregiver, by a motor, or by a magnetic drive system. Moreover, the various components of the lounger may be made of any material suitable for serving the component's purpose, such as, for example, the mattress may be formed from rubber, foam, or poly-fill batting and may or may not include a slipcover. Additionally, all of the optional features may or may not be included, and furthermore may be modified from the embodiments disclosed.

Additional embodiments within the scope of the invention optionally include alternate non-flat support base configurations, both rocking and non-rocking. Vibration and/or sound transducers may be included to soothe and/or stimulate a user. While described herein primarily with regard to embodiments for supporting an infant or child, the size and shape of the lounger may be alternatively configured for use with human or animal users of various age and size. An upper support member or frame may be included, for example to support a canopy or mobile above the lounger's seated or reclining surface. A toy bar or bumper bar can extend over or across the lounger's upper surface.

A self-storing blanket can optionally be retained in a chamber or opening within the lounger, which can be pulled out when needed and retracted for storage when not in use. One or more channels, perforations or recesses may be formed in the foam of the support surface, for example in the area underlying the head support area and/or elsewhere, to enhance airflow for comfort and breathability, and to provide ventilation and allow the child to breath more easily in the event the child accidentally flips onto their stomach and is positioned in a face-down position. A mesh or other breathable fabric is optionally applied over such airflow channels.

One or more storage pockets can be provided on various locations, for example on the outside of the lounger's cover fabric. Alternatively or additionally, one or more storage chambers or internal pockets can be formed within the foam base and/or within a molded plastic base of the lounger. One or more carry handle(s) can be provided on the slipcover and/or molded into or attached to the foam or plastic base shell. Squeakers, crinkle material and/or other audible and/or tactile feedback materials or devices can be integrated into the slipcover or otherwise provided in or on the lounger.

The slipcover is optionally provided with a water repellant or waterproof coating, lining or surface treatment. A slipcover similar to a stroller blanket can be provided, having sides that zip up to cover the child. An electromagnetic, mechanical or motor-driven auto-rocking actuator module may be incorporated, for example installed in a cutout area within the foam base or plastic base shell, to drive the lounger in a rocking motion. A removable or repositionable tray can optionally be provided, for feeding or for placement of toys for the child. The slipcover can comprise various openings or slot configurations for passage of straps of the harness therethrough, or the straps of the harness can be secured directly to the slipcover.

Alternate embodiments of the seat or mattress surface to support the child include flexible panels of mesh or fabric, providing a hammock-style or sling support surface for receiving the child therein. Alternatively, a rigid or semi-rigid seat or mattress support can include one or more folding or hinged segments to allow it to break down for storage and transportation. The support frame of the lounger can comprise various arrangements of collapsible and/or telescoping tubes or other support members, folding tubes or frame support members, removable tubes or frame support members, selectively inflatable air bladders, or other collapsible or retractable structural members, for reduced volume storage and/or transport.

While the invention has been described with reference to preferred and example embodiments, it will be understood by those skilled in the art that a variety of modifications, additions and deletions are within the scope of the invention, as defined by the following claims.

What is claimed is:

1. A rocking lounger for supporting an infant or child user in a reclined position on a support surface, the lounger comprising:

a main lounger body, comprising:

a central support portion comprising a first upper support surface for supporting the user's head and back, a second lower support surface for supporting the user's legs, a seat area between the upper and lower portions, first and second sides, and head and foot ends, wherein the upper and lower support surfaces of the central support portion are oriented at an obtuse angle relative of about 100°-170° relative to one another to support the infant or child in the reclined position;

first and second sidewalls extending along the first and second sides of the central support portion; and a base defining a lower and rearward outer convexly curved surface for supporting the lounger on the support surface, the curved surface extending at least partially between the head end and the foot end for providing a smooth rocking motion, the curved surface comprising at least one contact point in contact with the support surface and at least one point not in contact with the support surface at any moment during rocking, wherein the lounger is configured to provide a smooth rocking motion on the support surface along the curved surface of the base, wherein points along the curved surface are configured to contact the support surface during rocking of the lounger, and wherein the curved surface near the head and foot ends is elevated about 1-3 inches above a medial portion of the curved surface that contacts the underlying support surface in an equilibrium state;

a kickstand movable between at least a first position and a second position, the kickstand comprising a mounting end movably mounted to the main lounger body and a free end movable relative to the main lounger body, wherein in the first position the free end of the kickstand is retracted against the main lounger body and not protruding from below the base curved surface allowing rocking motion of the lounger, and wherein in the second position the free end of the kickstand is extending from at least a portion of the main lounger body to engage the support surface to prevent rocking motion of the lounger;

wherein the central support portion is removably attached to the first and second side portions for collapsible storage of the lounger; and further comprising first and second cross-bars removably attachable between the first and second side portions to form a support frame, and wherein the central support portion comprises releasable attachment means for engagement with the support frame.

2. The lounger of claim 1, wherein the central support portion comprises a foam body.

3. The lounger of claim 2, wherein the first and second side portions each comprise a foam core without a rigid outer covering.

4. The lounger of claim 1, further comprising a harness for retaining the user in the lounger.

5. The lounger of claim 4, wherein the harness comprises a three-point harness having a waist belt and a crotch strap.

6. The lounger of claim 1, wherein the central support portion comprises a molded plastic shell.

7. The lounger of claim 1, wherein the obtuse angle of the upper and lower support surfaces of the central support portion is about 120°-160°.

8. The lounger of claim 1, further comprising a slipcover removably covering the first and second side portions and the central support portion.

9. The lounger of claim 1, further comprising a headrest movably positioned on the central support portion.

10. The lounger of claim 1, further comprising a sound transmitter.

11. The lounger of claim 1, further comprising at least one tactile entertainment element.

12. The rocking lounger of claim 1, wherein the first and second sidewalls extend generally contiguously along the first and second sides of the central support portion and project a distance above the first and second support surfaces of the central support portion, wherein the first and second sidewalls are generally solid and without any openings and extend contiguously from the head end to the foot end, and wherein base lower curved surface extends substantially contiguously from the head end to the foot end.

13. A rocking lounger comprising:

a body comprising a central support portion and a first and second solid sidewall portion, the central support portion having an upper surface and a lower surface, first and second sides, a head end and a foot end, the upper surface defining a seating area and the lower surface being curved to permit a smooth rocking motion, the curved lower surface extending substantially continuously from the head end to the foot end without any discontinuities between the head end and the foot end that would interrupt the smooth rocking motion, the upper and lower support surfaces oriented at an obtuse angle of about 120°-160° relative to one another to support the infant or child in the reclined position, the first and second sidewalls extending contiguously along the first and second sides of the central support portion and projecting a distance above the upper surface of the central support portion, the first and second sidewalls being solid and without openings and extending continuously from the head end to the foot end;

a kickstand for selective operation to allow or prevent rocking of the body, the kickstand being movable between a first or retracted position and a second or extended position, wherein in the first position the kickstand is retracted within a recessed portion of the curved lower surface allowing rocking motion of the lounger, and wherein in the second position the kickstand is extending out of the recessed portion of the curved lower surface for preventing rocking motion of the lounger;

wherein in an equilibrium state the curved lower surface near the head and foot ends is elevated about 1-3 inches above a medial portion of the curved lower surface that contacts the underlying support surface;

wherein the central support portion is removably attached to the first and second side portions for collapsible storage of the lounger; and further comprising first and second cross-bars removably attachable between the first and second side portions to form a support frame, and wherein the central support portion comprises releasable attachment means for engagement with the support frame.

14. The lounger of claim 13, wherein the body comprises a plastic shell.

15. The lounger of claim 13, wherein the kickstand is pivotally mounted to the curved lower surface, wherein when the kickstand is in the first position retracted within the recessed portion of the curved lower surface allowing rocking motion of the lounger, the kickstand is positioned at or above the curved lower surface that rocks on the underlying support surface.

16. A rocking lounger for supporting an infant in a reclined position on an underlying support surface, the lounger comprising:

a foam body including a first sidewall, a second sidewall, and a central support portion positioned therebetween, wherein the first and second sidewalls and the central support collectively define a head end, an opposite foot end, a first side, a second opposite side, and an arcuate lower surface, wherein the first and second sidewalls each extend contiguously along the respective first and second sides of the central support portion from the head end to the foot end of the central support portion, project above the central support portion, and form respective first and second side surfaces of the foam body without a rigid outer covering, wherein the arcuate lower surface extends substantially continuously from the head end to the foot end of the central support portion to provide a smooth rocking motion, wherein in an equilibrium state a medial portion of the arcuate lower surface contacts the underlying support surface and a head portion of the arcuate lower surface adjacent the head end and a foot portion of the arcuate lower surface adjacent the foot end are elevated about 1 inch to about 3 inches above the medial portion of the arcuate lower surface, and wherein the central support portion includes an upper backrest support surface for supporting the infant's back and a lower seatrest support surface for supporting the infant's seat and upper legs, wherein the upper and lower support surfaces of the central support portion are oriented at an obtuse angle of about 120 degrees to about 160 degrees relative to one another to support the infant in the reclined position, and wherein the upper support surface of the central support portion is angled relative to the head portion of the arcuate lower surface so that when the head portion of the arcuate lower surface contacts the underlying support surface the upper support surface of the central support portion remains angled from horizontal;

wherein the central support portion is removably attached to the first and second side portions for collapsible storage of the lounger; and further comprising first and second cross-bars removably attachable between the first and second side portions to form a support frame, and wherein the central support portion comprises releasable attachment means for engagement with the support frame.

17. The lounger of claim 16, further comprising a removable slipcover applied over the foam body.

18. The lounger of claim 17, wherein the slipcover comprises a pocket, and further comprising a sound generator for removable placement in the pocket.

19. The lounger of claim 16, further comprising at least one strap for securing a user therein.

20. The lounger of claim 16, further comprising a headrest movably positioned on the central support portion.

21. The rocking lounger of claim 16, further comprising a kickstand that pivots between a use position and a stowed position, wherein in the stowed position the kickstand is positioned within a recess formed in the arcuate lower surface.

22. The lounger of claim 16, wherein the first and second side surfaces of the foam body are free of attachment to a carry handle or support shell.

23. The lounger of claim 16, wherein the first and second sidewalls are tapered with head and foot portions thereof having a greater height above the respective upper and lower support services than a medial portion thereof.

* * * * *